US007131875B2

(12) United States Patent
Kodaira et al.

(10) Patent No.: US 7,131,875 B2
(45) Date of Patent: Nov. 7, 2006

(54) CONTACT AND ELECTRICAL CONNECTOR

(75) Inventors: Kazuaki Kodaira, Tokyo (JP); Kenji Ikegami, Tokyo (JP); Chie Ohashi, Kanagawa (JP)

(73) Assignee: Tyco Electronics AMP K.K, Kanagawa-Ken (JP)

( * ) Notice: Subject to any disclaimer, the term of this patent is extended or adjusted under 35 U.S.C. 154(b) by 0 days.

(21) Appl. No.: 11/085,393

(22) Filed: Mar. 21, 2005

(65) Prior Publication Data

US 2005/0208834 A1 Sep. 22, 2005

(30) Foreign Application Priority Data

Mar. 19, 2004 (JP) ..... 2004-080399
Oct. 4, 2004 (JP) ..... 2004-291730

(51) Int. Cl.
*H01R 4/48* (2006.01)

(52) U.S. Cl. ..... 439/862

(58) Field of Classification Search ..... 439/862, 439/852, 853, 861, 662, 661, 652, 651
See application file for complete search history.

(56) References Cited

U.S. PATENT DOCUMENTS 5,259,769 A * 11/1993 Cruise et al. ..... 439/65
5,655,913 A * 8/1997 Castaneda et al. ..... 439/66
5,830,018 A * 11/1998 Simmel ..... 439/660
6,217,396 B1 4/2001 Hwang et al.
6,398,598 B1 * 6/2002 Masumoto ..... 439/862
6,447,338 B1 * 9/2002 Bricaud et al. ..... 439/630
6,551,149 B1 * 4/2003 Orihara ..... 439/862
6,616,485 B1 * 9/2003 Harasawa et al. ..... 439/630
6,875,049 B1 * 4/2005 Kyowski et al. ..... 439/500
2002/0019179 A1 2/2002 Masumoto
2003/0211787 A1 11/2003 Harasawa et al.

FOREIGN PATENT DOCUMENTS

DE 100 27 600 C1 6/2000
EP 1 381 116 A1 1/2004
JP D1108677 5/2001
JP 2003-168510 6/2003

* cited by examiner

*Primary Examiner*—Phuong Dinh
(74) *Attorney, Agent, or Firm*—Barley Snyder LLC

(57) ABSTRACT

The invention provides a contact and an electrical connector which are used to electrically connect a conductor pattern formed on a circuit board and a component to be connected that is positioned to face the circuit board, and in which the amount of displacement of the contact protruding part is large, while having a low height. The contact has a soldering part which is soldered to a conductor pattern formed on a circuit board, a spring arm which extends from the soldering part and which has a contact protruding part for contacting a component to be connected that is positioned to face the circuit board, and preload application parts which extend from the soldering part and contact the spring arm so that a preload is applied to the spring arm. The preload application parts are provided toward the fixed end of the spring arm relative to the contact protruding part.

10 Claims, 13 Drawing Sheets

CONTACT AND ELECTRICAL CONNECTOR

FIELD OF THE INVENTION

The present invention relates to a contact and an electrical connector for electrically connecting a conductor pattern formed on a circuit board and a component to be connected that is positioned to face the circuit board.

BACKGROUND

Conventionally, for example, the contact shown in FIG. 13 (see Japanese Patent Application Kokai No. 2003-168510) has been known as a contact of this type.

This contact 101 comprises a soldering part 102 that extends in the forward-rearward direction (left-right direction in FIG. 13) and that is soldered to a ground pattern formed on a circuit board PCB, a pair of side wall parts 103 that rise from either end portions of the soldering parts 102 in the direction of width (direction perpendicular to the plane of the page in FIG. 13), and a spring arm 104 that extends from one of the side wall parts 103. The contact 101 is formed by stamping and forming a metal plate. The spring arm 104 comprises a tongue part 104*a* that is bent inward from the front end of one of the side wall parts 103, a rectilinear part 104*c* that extends upward at an inclination toward the rear from the tongue part 104*a* via a first bent part 104*b*, a contact protruding part 104*e* that is bent back toward the front from the rectilinear part 104*c* via a second bent part 104*d* and curved into an upward convex shape by protruding upward from the side wall part 103, and an extension part 104*f* that extends forward from the contact protruding part 104*e*.

The contact protruding part 104*e* is contacted from above by a ground conductor 110 that is positioned to face the circuit board PCB, so that the ground conductor 110 and the ground pattern formed on the circuit board PCB are electrically connected. Furthermore, the pair of side wall parts 103 are connected by connection parts 105 and 106 at both upper end portions in the forward-rearward direction. The connection part 105 toward the front contacts the extension part 104*f* of the spring arm 104, so that the extension part 104*f* is protected. Meanwhile, the connection part 106 toward the rear contacts the second bent part 104*d* of the spring arm 104, so that a preload is applied to the spring arm 104 by this connection part 106 contacting the second bent part 104*d*. Thus, as a result of the preload being applied to the spring arm 104, a load is applied to the spring arm 104 even before the ground conductor 110 contacts the contact protruding part 104*e*, so that the fluctuation of the load per the amount of displacement of the spring arm 104 can be reduced.

Furthermore, the contact shown in FIGS. 14A to 14D (see Design Registration No. 1108677), for example, has also been known as another conventional example of a contact.

This contact 201 comprises a soldering part 202 that extends in the forward-rearward direction (left-right direction in FIG. 14D) and that is soldered to a ground pattern formed on a circuit board PCB1, and a spring arm 203 that extends from the rear end of the soldering part 202. The contact 201 is formed by stamping and forming a metal plate. The spring arm 203 comprises a rising part 203*a* that rises from the rear end of the soldering part 202, a rectilinear part 203*c* that extends forward by being bent back from the rising part 203*a* via a bent part 203*b*, a contact protruding part 203*d* that is curved into an upward convex shape by protruding upward from the tip end of the rectilinear part 203*c*, and an extension part 203*e* that extends forward from the contact protruding part 203*d*.

A casing or a ground pattern formed on a separate circuit board PCB2 that is positioned to face the circuit board PCB1 contacts the contact protruding part 203*d* from above, so that the conductor part of the casing or the ground pattern of this separate circuit board PCB2 is electrically connected to the ground pattern formed on the circuit board PCB1. Furthermore, a pair of side wall parts 204 are formed in an upright manner toward the front on either side of the soldering part 202 in the direction of width (direction perpendicular to the plane of the page in FIG. 14D), and preload application parts 205 extend inward from the upper end portions of these side wall parts 204. The preload application parts 205 are disposed on the extension part 203*e* of the spring arm 203, so that a preload is applied to the spring arm 203 by this contact with the extension part 203*e*.

However, the following problems have been encountered in these conventional contacts.

Specifically, in the case of the contact 101 shown in FIG. 13, since the connection part 106 that applies a preload to the spring arm 104 is located farther from the tongue part 104*a* (i.e., the fixed end of the spring arm 104) than the contact protruding part 104*e*, the distance from the fixed end to the contact protruding part 104*e* is smaller than the distance from the fixed end to the connection part 106. Accordingly, when the ground conductor 110 contacts the contact protruding part 104*e* from above and continues the displacement of the contact protruding part 104*e* in this state, there is a danger that the second bent part 104*d* located beneath the connection part 106 will contact the upper surface of the soldering part 102 while the amount of displacement of the contact protruding part 104*e* is insufficient, so that the amount of displacement of the contact protruding part 104*e* will be limited by the second bent part 104*d*.

Furthermore, in the case of the contact 201 shown in FIGS. 14A to 14D as well, since the preload application parts 205 that apply a preload to the spring arm 203 are positioned farther than the contact protruding part 203*d* from the rising part 203*a* constituting the fixed end of the spring arm 203, the distance from the fixed end to the contact protruding part 203*d* is smaller than the distance from fixed part to the preload application parts 205. Accordingly, when the casing or the ground pattern formed on the circuit board PCB2 contacts the contact protruding part 203*d* from above and continues the displacement of the contact protruding part 203*d* in this state, there is a danger that the extension part 203*e* located beneath the preload application parts 205 will contact the upper surface of the soldering part 202 while the amount of displacement of the contact protruding part 203*d* is insufficient, so that the amount of displacement of the contact protruding part 203*d* will be limited by the extension part 203*e*. It is conceivable to set the extension part 203*e* at a higher position in order to prevent the amount of displacement of the contact protruding part 203*d* from being limited. In this case, however, the preload application parts 205 must be disposed above the extension part 203*e* that is positioned higher than in the case of conventional contacts. Accordingly, the difference in height between the upper end of the contact protruding part 203*d* and the upper surfaces of the preload application parts 205 is reduced; as a result, the amount of displacement of the contact protruding part 203*d* is limited.

In particular, in the electrical connection between a ground pattern formed on a circuit board and a component to be connected (a casing or a ground pattern formed on another circuit board) that is positioned to face the circuit board in the field of portable telephone equipment and the like, it is desired to use a contact in which the amount of displacement of the contact protruding part is large, while the height of the contact is low. Since the amount of displacement of the contact protruding parts 104*e* and 203*d* is limited in the contacts shown in FIGS. 13, and 14A to 14D, the use of these contacts is not preferable.

FIGS. 12A and 12B show conventional examples of an electrical connector to which is applied a method for applying a preload to the spring arms of the contacts by portions of the housing. In FIGS. 12A and 12B, an electrical connector 60 comprises a plurality of contacts 80 and a housing 70 that accommodates these contacts 80, and is designed to be surface-mounted on a circuit board (not shown in the figure). The housing 70 has a plurality of first contact accommodating cavities 71 that open in the front surface (left surface in FIG. 12B) of the housing 70, and a plurality of second contact accommodating cavities 72 that open in the rear surface of the housing 70. The first contact accommodating cavities 71 and second contact accommodating cavities 72 are designed to respectively accommodate the contacts 80.

Each of the contacts 80 comprises a flat base plate 81, a soldering part 82 that extends from one end of the base plate 81 and that is soldered to a conductor pattern formed on a circuit board, and a spring arm 83 that extends from the other end of the base plate 81. Engaging parts 84 that are press-fitted to press-fitting holes respectively formed on both side walls of the first contact accommodating cavities 71 and second contact accommodating cavities 72 are provided on both sides of the base plates 81. Furthermore, each spring arm 83 extends toward one end of the base plate 81 by being bent back from the other end via a bent part; these spring arms 83 are designed to be contacted by a component to be connected (not shown in the figure) that is positioned to face the circuit board.

Furthermore, preload application parts 73 that apply a preload to the spring arms 83 are provided on the respective molded parts of the first contact accommodating cavities 71 and second contact accommodating cavities 72. The tip ends of the spring arms 83 are bent back and positioned in contact with the undersurfaces of the preload application parts 73, so that a preload is applied to the spring arms 83.

In the electrical connector 60 constructed in this manner, the soldering parts 82 of the contacts 80 that are respectively accommodated in the first contact accommodating cavities 71 and second contact accommodating cavities 72 are connected by reflow soldering to the conductor pattern formed on the circuit board, so that the electrical connector 60 is surface-mounted on the circuit board. During the connection of these soldering parts 82 by reflow soldering, the preload application parts 73 formed on the housing 70 are deformed due to the heat during this heating, so that there are cases in which the preload for the spring arms 83 is varied. In order to avoid this, it is conceivable to increase the thickness of the preload application parts 73, thus preventing the deformation of these preload application parts. However, if the thickness of the preload application parts 73 is thus increased, the height of the housing 70 will be increased.

SUMMARY

The present invention was devised in light of the problems described above; it is an object of the present invention to provide a contact and an electrical connector which are used to electrically connect a conductor pattern formed on a circuit board and a component to be connected that is positioned to face the circuit board, and in which the amount of displacement of the contact protruding part is large, while having a low height.

In order to solve the problems described above, the contact comprises a soldering part that is soldered to a conductor pattern formed on a circuit board, a spring arm that extends from this soldering part and that has a contact protruding part for contacting a component to be connected that is positioned to face the circuit board, and a preload application part that extends from the soldering part and contacts the spring arm, so that a preload is applied to the spring arm, wherein the preload application part is provided toward the fixed end of the spring arm relative to the contact protruding part. The term "conductor pattern" may include either a ground pattern or a signal pattern.

DESCRIPTION OF THE EMBODIMENT(S)

Figure 1:
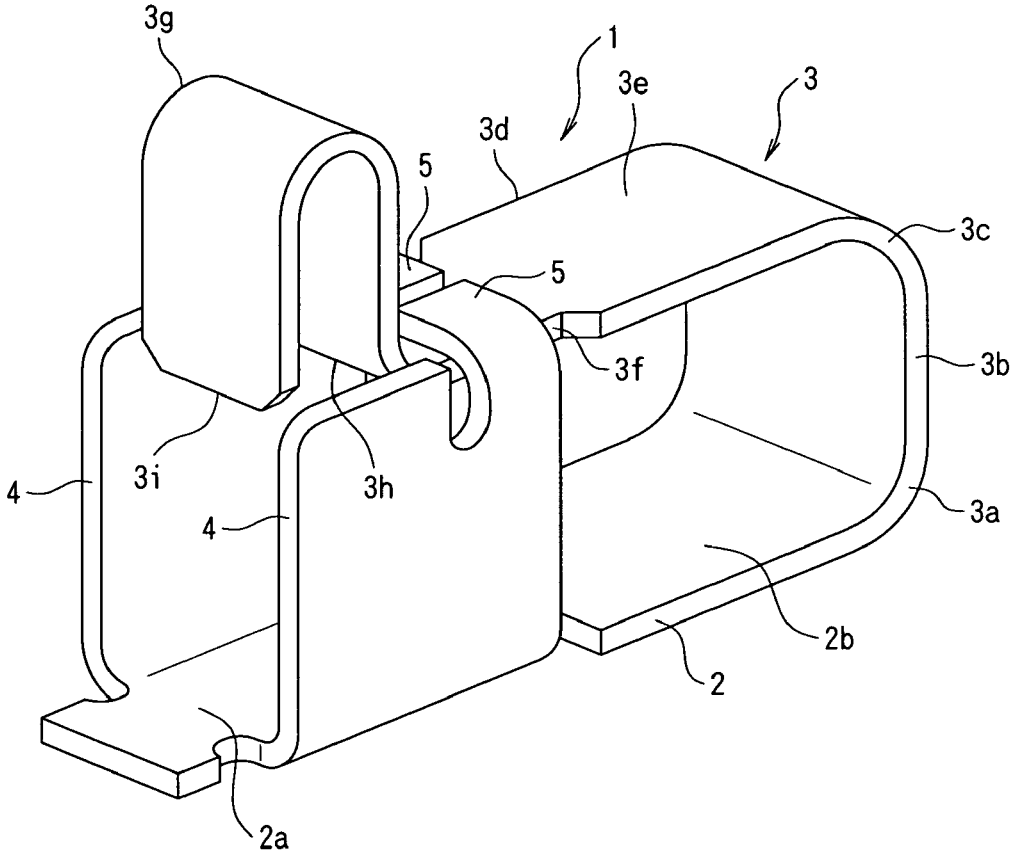
FIG. 1 is a perspective view of a contact according to a first exemplary embodiment of the present invention.

Next, embodiments of the present invention will be described with reference to the figures. In FIGS. 1, and 2A to 2E, a contact 1 comprises a soldering part 2 that extends in the forward-rearward direction (left-right direction in FIG. 2E) and that is soldered to a conductor pattern formed on a circuit board PCB, a spring arm 3 that extends from the rear end of the rear portion 2*b* of the soldering part 2, and a pair of side wall parts 4 that rise from either side of the front portion 2*a* of the soldering part 2 in the direction of width (direction perpendicular to the plane of the page in FIG. 2E). The contact 1 is formed by stamping and forming a conductive metal plate that has elasticity.

Here, the soldering part 2 is formed so that the width of the front portion 2*a* where the side wall parts 4 rise is small, and the width of the rear portion 2*b* where no side wall parts 4 rise is large; this soldering part 2 is designed to be connected by soldering to the conductor pattern formed on the circuit board PCB.

The spring arm 3 comprises a rising part 3*b* that rises from the rear portion 2*b* of the soldering part 2 via a first bent part 3*a*, a rectilinear part 3*d* that extends forward by being bent back from the rising part 3*b* via a second bent part 3*c*, and a contact protruding part 3*g* that is curved into an upward convex shape by protruding upward from the front end of the rectilinear part 3*d*. The rising part 3*b* rises, having the same width as that of the rear portion 2*b* of the soldering part 2 and the first bent part 3*a*. Furthermore, the width of the second bent part 3*c* changes from the same width as that of the rising part 3*b* to a slightly smaller width, and the rectilinear part 3*d* is constructed from a rear portion 3*e* whose width is smaller than that of the rising part 3*b*, and a front portion 3*f* whose width is even smaller than that of this rear portion 3*e*. The contact protruding part 3*g* is constructed with the same width as that of the front portion 3*f* of the rectilinear part 3*d*, and is designed to be contacted by a casing (component to be connected) 10 of a portable telephone or the like that is positioned to face the circuit board PCB. As is shown most clearly in FIGS. 1 and 2D, the lower end 3*i* of the contact protruding part 3*g* on the side distant from the fixed end (rising part 3*b*) of the spring arm 3 is located slightly above the lower end 3*h* of the contact protruding part 3*g* on the side closer to the fixed end of the spring arm 3. Therefore, when the contact protruding part 3*g* is displaced downward, the lower end 3*h* on the side closer to the fixed end of the spring arm 3 first contacts the upper surface of the soldering part 2, and the lower end 3*i* on the side distant from the fixed end of the spring arm 3 is then allowed to make this contact. Both corners of the lower end 3*i* on the side distant from the fixed end of the spring arm 3 are beveled, thus preventing interference with the side wall parts 4 when this lower end is lowered.

Furthermore, the width between the inner wall surfaces of the pair of side wall parts 4 is formed to be slightly larger than the width of the contact protruding part 3*g*, and the pair of side wall parts 4 function as guide parts that guide the displacement of the contact protruding part 3*g*. Moreover, a pair of preload application parts 5 are provided which are bent inward from the respective upper rear end portions of the pair of side wall parts 4. These preload application parts 5 are formed toward the fixed end of the spring arm 3 relative to the contact protruding part 3*g*, and are disposed on the front portion 3*f* of the rectilinear part 3*d* of the spring arm 3, so that a preload is applied to the spring arm 3. The pair of side wall parts 4 that function as guide parts are integrally formed with the preload application parts 5. By the preload being applied to the spring arm 3, a load is applied to the spring arm 3 even before the casing 10 contacts the contact protruding part 3*g*, so that it is possible to reduce the fluctuation of the load per the amount of displacement of the spring arm 3.

The contact 1 that is constructed in this manner is mounted on the circuit board PCB by the solder connection of the soldering part 2 to the conductor pattern (not shown in the figures) formed on the circuit board PCB.

Figure 2A:
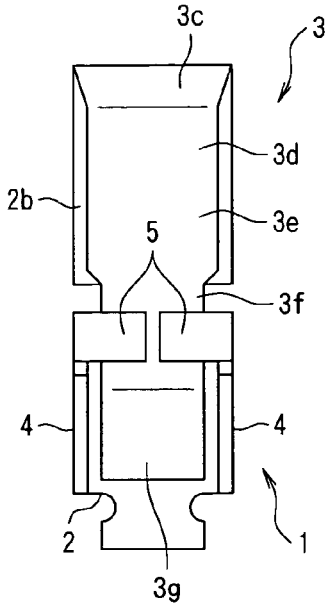
FIGS. 2A to 2E show the contact shown in FIG. 1, with FIG. 2A being a plan view, FIG. 2B being a back view, FIG. 2C being a bottom view, FIG. 2D being a front view, and FIG. 2E being a right-side view (in FIG. 2E, a circuit board and a casing are both shown as a one-dot chain line)
Figure 2C:
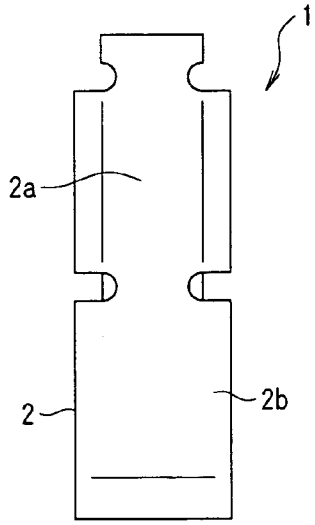
Figure 2B:
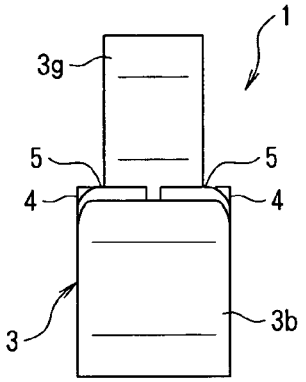
Figure 2D:
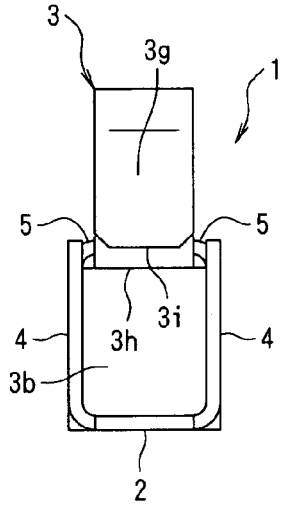
Figure 2E:
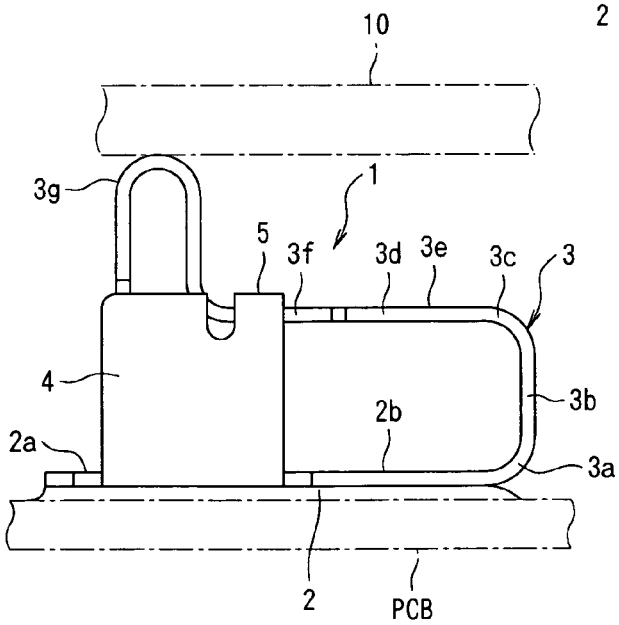
Figure 3A:
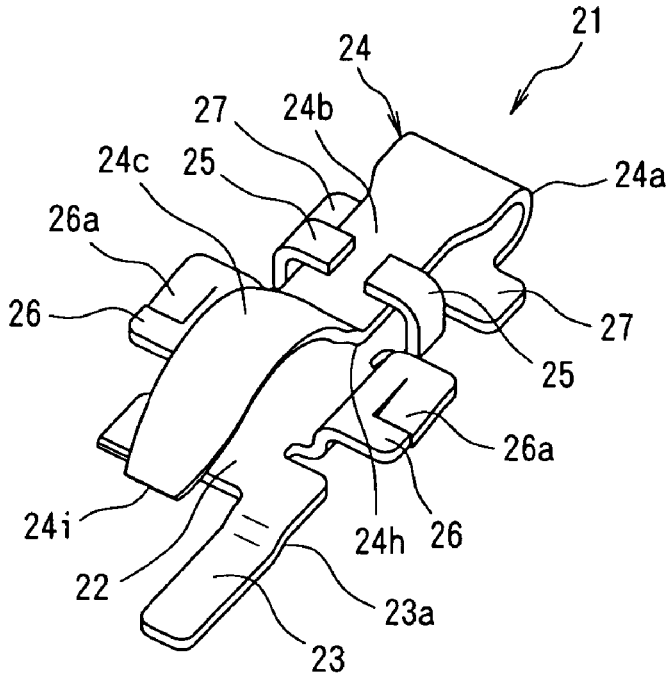
FIGS. 3A and 3B are perspective views of a contact according to a second exemplary embodiment of the present invention, with FIG. 3A being a perspective view as seen from the front at an inclination from above, and FIG. 3B being a perspective view as seen from the back at an inclination from below.
Figure 3B:
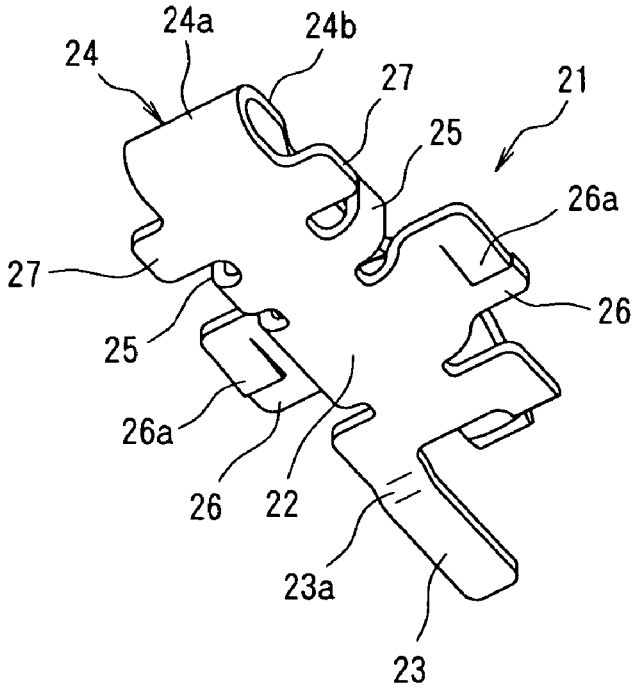

Furthermore, as is shown in FIG. 2E, when the casing 10 contacts the contact protruding part 3*g* from above, the casing 10 and the conductor pattern formed on the circuit board PCB are electrically connected. When the casing 10 is lowered to a specified position, the contact protruding part 3*g* is displaced downward for a specified amount against the elastic force of the spring arm 3; in this state, the work of connecting the casing 10 and the conductor pattern formed on the circuit board PCB is completed. In this case, the downward displacement of the contact protruding part 3*g* is guided by the pair of side wall parts 4. Moreover, the contact protruding part 3*g* can be protected from the outside by the pair of side wall parts 4; for example, it is possible to prevent an electrical wire and the like from being entwined around the lower end 3*i* of the contact protruding part 3*g* on the side distant from the fixed end of the spring arm 3.

If the displacement of the contact protruding part 3*g* is continued, the lower end 3*h* of the contact protruding part 3*g* on the side closer to the fixed end of the spring arm 3 first contacts the upper surface of the soldering part 2, and the lower end 3*i* on the side distant from the fixed end of the spring arm 3 subsequently makes this contact.

Here, in the present embodiment, the preload application parts 5 are provided toward the fixed end of the spring arm 3 relative to the contact protruding part 3*g*. Accordingly, there is no need to form any extension part of the contact that positions beneath the preload application parts 5 that are positioned farther from the fixed end of the spring arm than the contact protruding part 3*g*. Consequently, in cases where the casing 10 contacts the contact protruding part 3*g* and continues the displacement of the contact protruding part 3*g* in this state, since no extension part is provided (unlike the prior art), there is no possibility of such an extension part contacting the upper surface of the soldering part before the lower end of the contact protruding part 3*g*, thus eliminating a danger that the amount of displacement of the contact protruding part 3*g* will be limited by such an extension part. Accordingly, it is possible to obtain a contact 1 that has a large amount of displacement of the contact protruding part 3*g*, while having a low height.

When the state of contact of the casing 10 with the contact protruding part 3*g* is released, the contact protruding part 3*g* is displaced upward by the elastic force of the spring arm 3 and returned to the original position. In this case, the upward displacement of the contact protruding part 3*g* is guided by the pair of side wall parts 4.

Figure 4A:
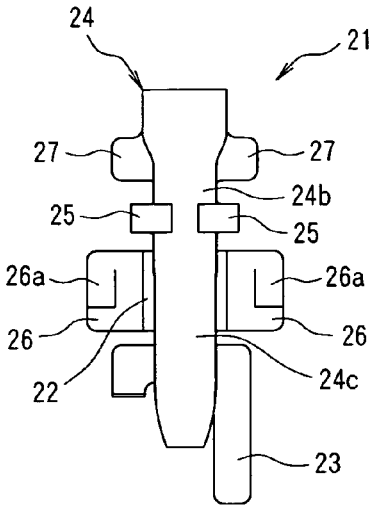
FIGS. 4A to 4F show the contact shown in FIGS. 3A and 3B, with FIG. 4A being a plan view, FIG. 4B being a back view, FIG. 4C being a bottom view, FIG. 4D being a front view, FIG. 4E being a left-side view, and FIG. 4F being a right-side view (in FIG. 4F, a circuit board and a component to be connected are both shown as a one-dot chain line)
Figure 4C:
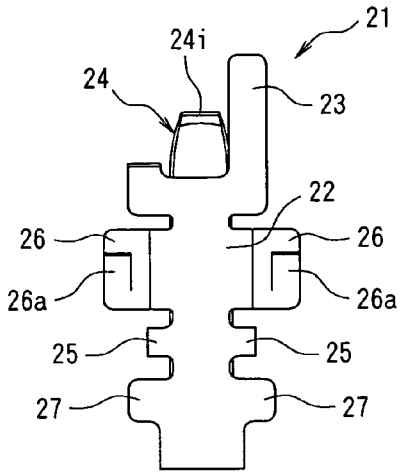
Figure 4B:
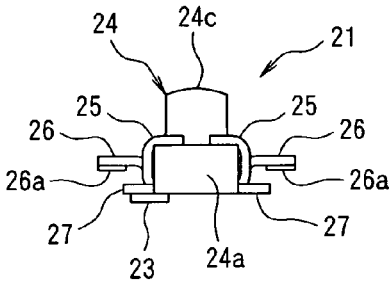
Figure 4D:
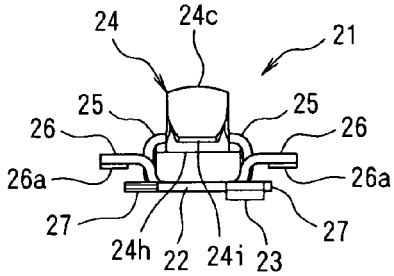
Figure 4E:
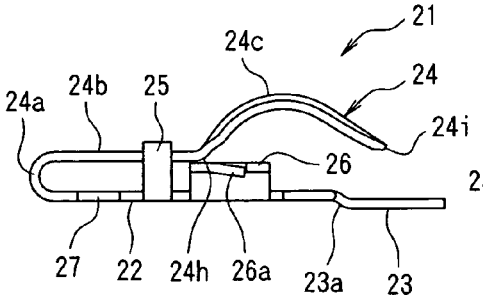
Figure 4F:
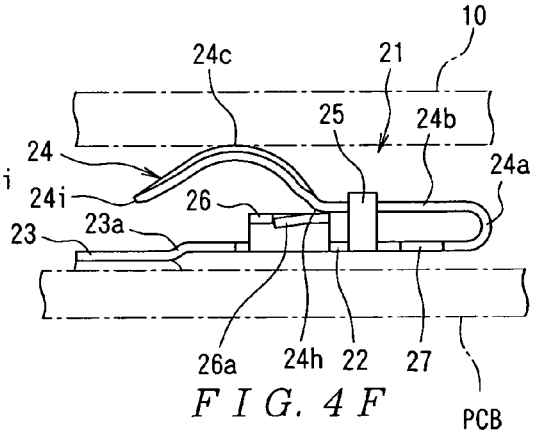
Figure 5A:
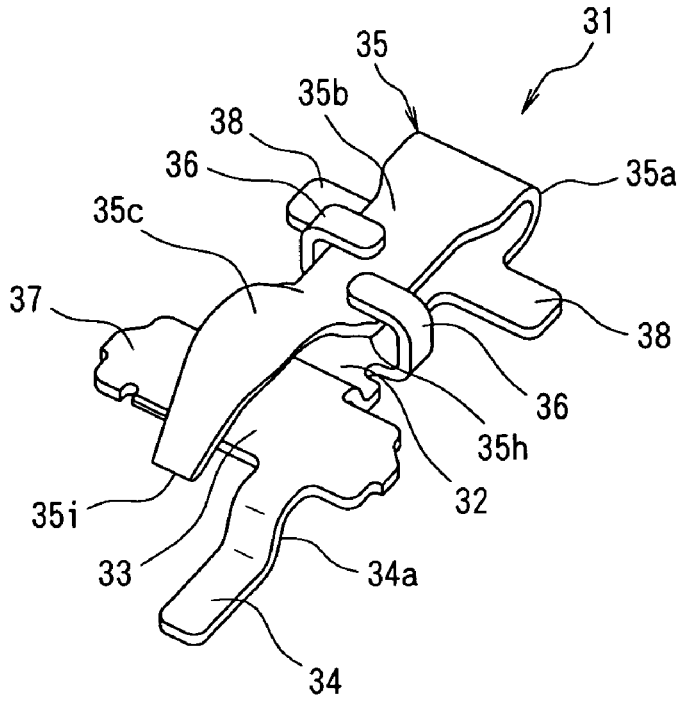
FIGS. 5A and 5B are perspective views of a contact according to a third exemplary embodiment of the present invention, with FIG. 5A being a perspective view as seen from the front at an inclination from above, and FIG. 5B being a perspective view as seen from the back at an inclination from below.
Figure 5B:
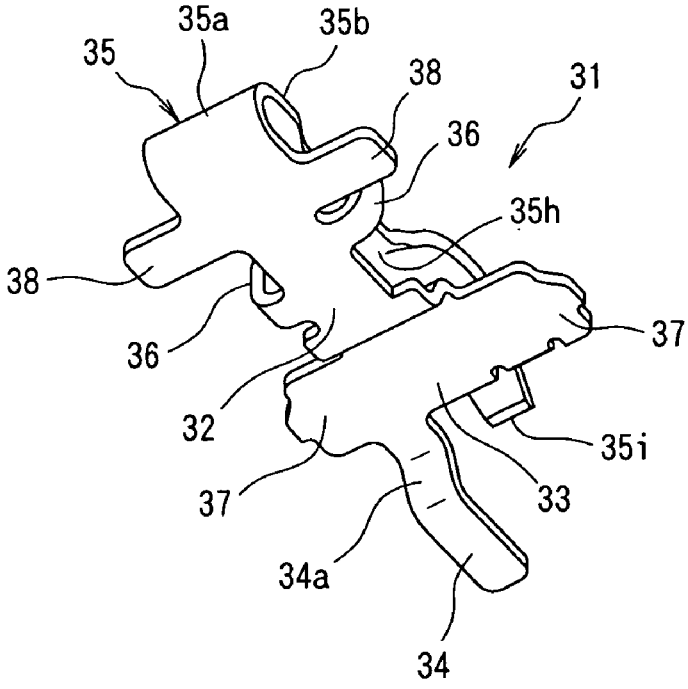

Next, a contact according to a second exemplary embodiment of the present invention will be described with reference to FIGS. 3A and 3B, and 4A to 4F. In FIGS. 3A and 3B, and 4A to 4F, a contact 21 comprises a flat base plate 22 that extends in the forward-rearward direction (left-right direction in FIG. 4F). The contact 21 is formed by stamping and forming a metal plate that has elasticity such as a copper alloy. A soldering part 23 extends forward from the front end of the base plate 22 toward one side (toward the right side in FIG. 4A) via a step 23*a* that extends downward at an inclination. The soldering part 23 is connected by reflow soldering to a conductor pattern formed on a circuit board PCB. Meanwhile, a spring arm 24 extends from the rear end of the base plate 22. In effect, the spring arm 24 extends from the soldering part 23 via the base plate 22. The spring arm 24 comprises a rectilinear part 24*b* that is bent back toward the front from the rear end of the base plate 22 via a bent part 24*a*, and a contact protruding part 24*c* that is curved into an upward convex shape by protruding upward from the front end of the rectilinear part 24*b*. The rectilinear part 24*b* is formed with a slightly smaller width than that of the bent part 24*a*, and the contact protruding part 24*c* is formed with substantially the same width as that of the rectilinear part 24*b*. As is shown in FIG. 4F, the contact protruding part 24*c* is designed to be contacted by a component to be connected 10 that is positioned to face the circuit board PCB. The contact protruding part 24*c* is formed in an upward convex shape in the form of a spoon or a dome, and this prevents damage to the mating contact that is inserted and removed. As is shown most clearly in FIGS. 4D and 4F, the lower end 24*i* of the contact protruding part 24*c* on the side distant from the fixed end (bent part 24*a*) of the spring arm 24 is positioned slightly above the lower end 24*h* of the contact protruding part 24*c* on the side closer to the fixed end of the spring arm 24. Therefore, when the contact protruding part 24*c* is displaced downward, the lower end 24*h* on the side closer to the fixed end of the spring arm 24 first contacts the upper surface of the base plate 22, and the lower end 24*i* on the side distant from the fixed end of the spring arm 24 can then contact the circuit board PCB. Both corners of the lower end 24*i* on the side distant from the fixed end of the spring arm 24 are beveled, thus preventing interference with the soldering part 23 when this lower end is lowered.

Furthermore, a pair of preload application parts 25 are raised from either side of the base plate 22 in the direction of width substantially in the central portion in the forward-rearward direction. These preload application parts 25 are formed toward the fixed end of the spring arm 24 relative to the contact protruding part 24*c*, and are bent over the rectilinear part 24*b* of the spring arm 24, so that a preload is applied to the spring arm 24. The pair of preload application parts 25 are provided to face each other on either side of the contact 21 in the direction of width. The inner surfaces of the rising parts of the respective preload application parts 25 function as guide parts that guide the displacement of the contact protruding part 24*c* when the spring arm 24 is displaced. The displacement of the contact protruding part 24*c* can be securely guided by providing the pair of preload application parts 25 so that these preload application parts face each other on either side of the contact 21 in the direction of width. As a result of the preload being applied to the spring arm 24, a load is applied to the spring arm 24 even before the component to be connected 10 contacts the contact protruding part 24*c*, so that it is possible to reduce the fluctuation of the load per the amount of displacement of the spring arm 24.

Moreover, a pair of first engaging parts 26 (provided on the side opposite from the fixed end of the spring arm with respect to the preload application parts) are raised from either side of the base plate 22 in the direction of width on the side opposite from the fixed end of the spring arm 24 with respect to the preload application parts 25. These first engaging parts 26 are constructed so that these first engaging parts are first raised from either side of the base plate 22 in the direction of width and then extend to the outside; these first engaging parts are designed to be press-fitted to a housing 50 (see FIGS. 7A and 7B, 8A to 8C, 9A to 9C, 10 and 11) that is described below. Raised cut parts 26*a* that cut into the housing 50 are provided in the portions of the respective first engaging parts 26 that extend to the outside. Furthermore, a pair of second engaging parts 27 extend substantially parallel to the base plate 22 from either edge portion of the base plate 22 in the direction of width on the side of the fixed end of the spring arm 24 with respect to the preload application parts 25. These second engaging parts 27 are designed to engage with slits 53 (see FIG. 7 FIGS. 7A and 7B, 8A to 8C, and 9A to 9C) formed in the housing 50. Although this will be described later, the slits 53 with which the second engaging parts 27 engage are formed by grooves that open on the side of the undersurface of the housing 50. Since the first engaging parts 26 are press-fitted to the housing 50, the press-fitting holes for the first engaging parts 26 formed in the housing 50 are required to have thicker sections in the vertical direction. Accordingly, as is shown in FIGS. 4E and 4F, the first engaging parts 26 are provided at a high location relative to the second engaging parts 27, and the second engaging parts 27 are provided at a low location relative to the first engaging parts 26.

The contacts 21 constructed in this manner are accommodated in the housing 50 shown in FIGS. 7A and 7B, 8A to 8C, 9A to 9C, 10 and 11 to constitute an electrical connector 40. The electrical connector 40 shown in FIGS. 7A and 7B, 8A to 8C, 9A to 9C, 10 and 11 comprises a plurality of the contacts 21 described above and the housing 50 that accommodates these contacts 21, and is designed to be surface-mounted on the circuit board PCB (see FIG. 4F). The electrical connector 40 is shown as a SIM (subscriber identify module) card connector in the present embodiment.

The housing 50 has a plurality of first contact accommodating cavities 51 that open in the front surface (surface at the bottom in FIG. 8A) of the housing 50, and a plurality of second contact accommodating cavities 52 that open in the rear surface of the housing 50. The first contact accommodating cavities 51 and second contact accommodating cavities 52 respectively accommodate the contacts 21 in an orientation in which the bent parts 24*a* face in the same direction with each other.

The press-fitting holes (not shown in the figures) to which the first engaging parts 26 of the contacts 21 are press-fitted are formed in the vicinity of the respective centers of the first contact accommodating cavities 51 and second contact accommodating cavities 52 in the direction of height. Furthermore, the slits 53 with which the second engaging parts 27 of the contacts 21 engage are formed in the respective bottom portions of the first contact accommodating cavities 51 and second contact accommodating cavities 52 by grooves that open on the side of the undersurface of the housing 50. With regard to the slits 53, it would be sufficient as long as these are designed to restrict the movement of the contacts 21 by being engaged with the second engaging parts 27; it would also be possible to use holes or recessed parts formed in the housing 50.

Furthermore, some of the contacts 21 are inserted into the first contact accommodating cavities 51 from the front surface of the housing 50, with the fixed end side of the spring arms 24 inserted first. In addition, the other contacts 21 are inserted into the second contact accommodating cavities 52 from the rear surface of the housing 50, with the fixed end side of the spring arms 24 inserted first. When these contacts 21 are respectively inserted into the first contact accommodating cavities 51 and second contact accommodating cavities 52, the first engaging parts 26 of the contacts 21 are press-fitted to the press-fitting holes, and the second engaging parts 27 are engaged with the slits 53. When the second engaging parts 27 are engaged with the slits 53, floating of the contacts 21 is restricted. Furthermore, the outer edge portions of the respective second engaging parts 27 contact both inner edges of the slits 53 that are constructed by grooves, so that the lateral wobbling (wobbling in the left-right direction in FIG. 4A) of the contacts 21 on the side of the fixed ends of the spring arms 24 is restricted. The lateral wobbling of the contacts 21 on the side opposite from the fixed ends of the spring arms 24 is restricted by the first engaging parts 26 being press-fitted to the housing 50.

Moreover, as is shown in FIG. 4F, the soldering parts 23 of the contacts 21 respectively accommodated in the first contact accommodating cavities 51 and second contact accommodating cavities 52 are connected by reflow soldering to a conductor pattern (not shown in the figures) formed on the circuit board PCB, so that the electrical connector 40 is surface-mounted on the circuit board PCB.

During the connection of these soldering parts 23 by reflow soldering, the contacts 21 are pulled by the solder, so that the contacts 21 tend to float. However, the first engaging parts 26 and second engaging parts 27 that engage with the housing 50 are provided on the contacts 21 both on the side of the fixed ends of the spring arms 24 and on the side opposite from the fixed ends of the spring arms 24 with respect to the preload application parts 25; accordingly, it is possible to prevent the contacts 21 from floating by means of both engaging parts 26 and 27 even if the contacts 21 are pulled by the solder.

Figure 12A:
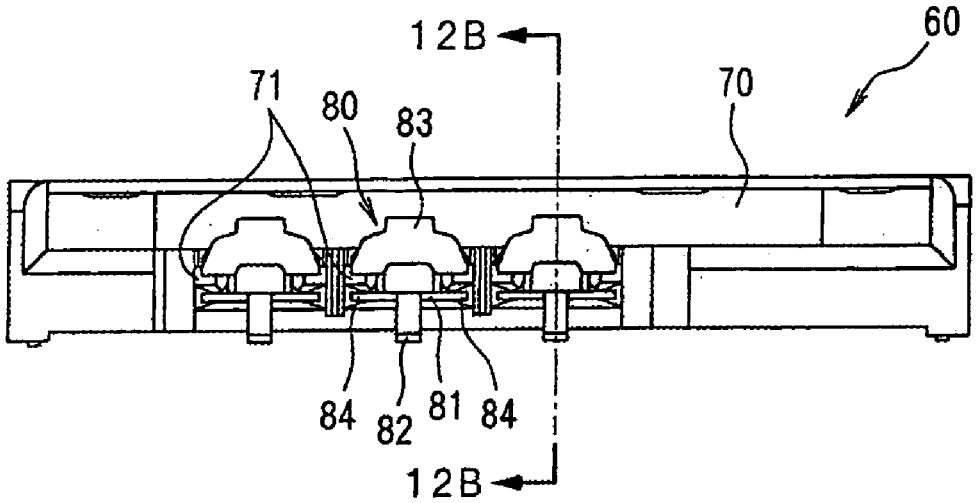
FIG. 12A PRIOR ART
FIGS. 12A and 12B show conventional examples of an electrical connector to which is applied a method for applying a preload to the spring arms of the contacts by portions of the housing, with FIG. 12A being a front view, and FIG. 12B being a sectional view along line 12B—12B in FIG. 12A.
Figure 12B:
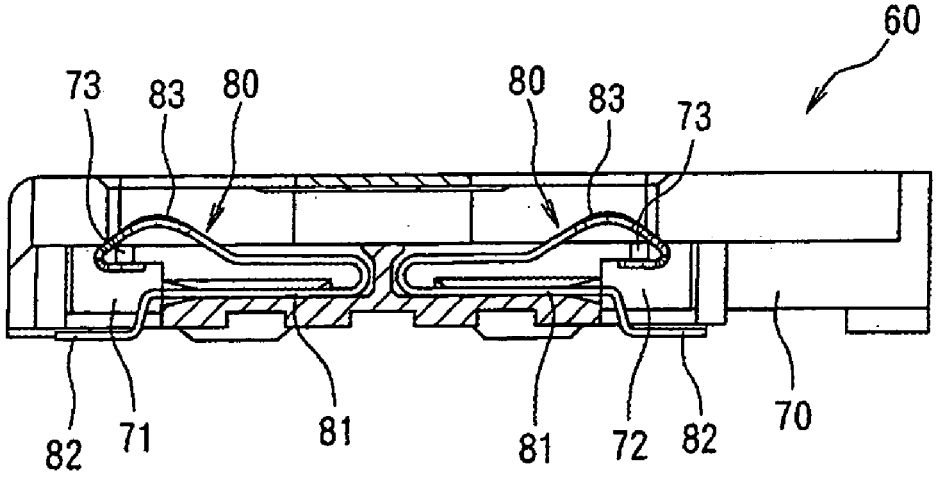
FIG. 12B PRIOR ART
Figure 13:
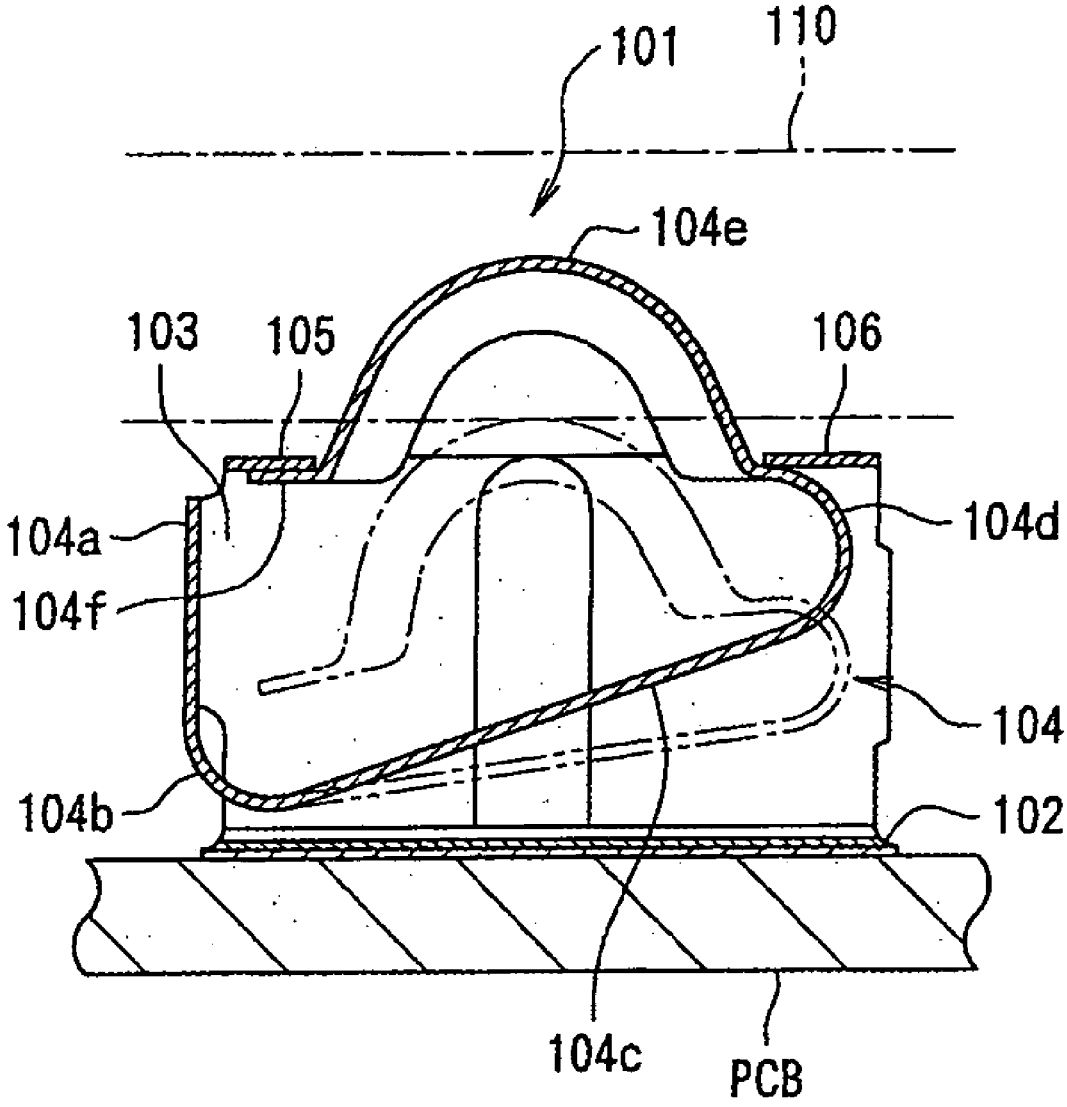
FIG. 13 PRIOR ART
FIG. 13 is a sectional view of a conventional example of a contact.
Figure 14A:
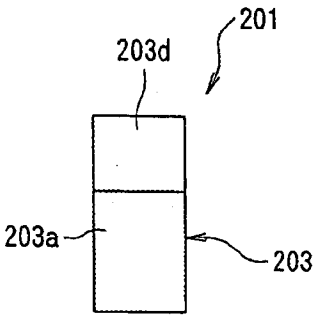
FIG. 14 A PRIOR ART
FIGS. 14A to 14D show another conventional examples of a contact, with FIG. 14A being a back view, FIG. 14B being a right-side view, FIG. 14C being a front view, and FIG. 14D being a right-side sectional view (in FIG. 14D, a circuit board and a separate circuit board are both shown).
Figure 14B:
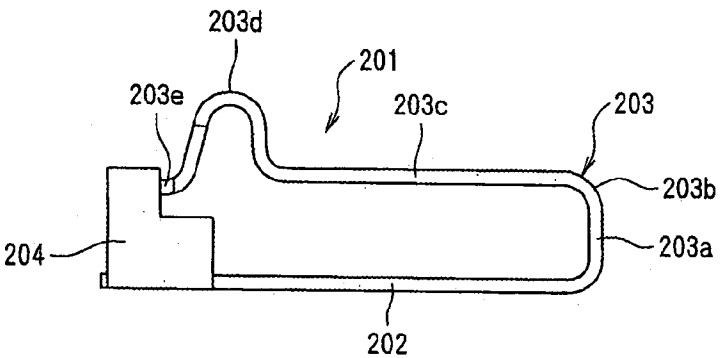
FIG. 14 B PRIOR ART
Figure 14C:
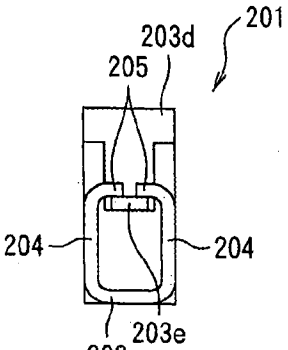
FIG. 14 C PRIOR ART
Figure 14D:
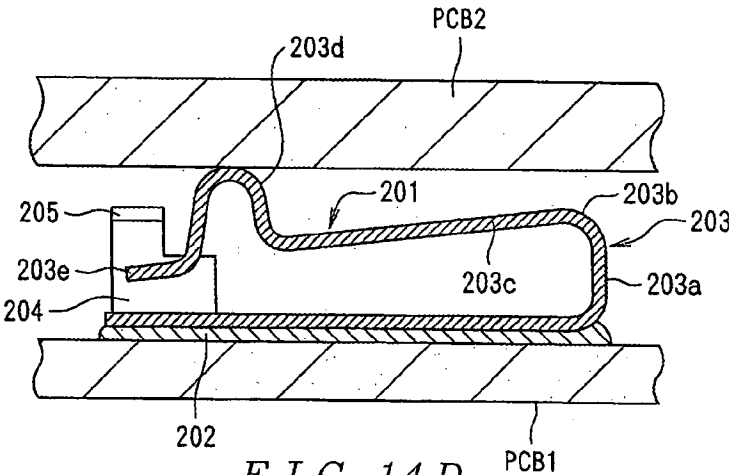
FIG. 14 D PRIOR ART

In the electrical connector 40 shown in FIGS. 7A and 7B, 8A to 8C, 9A to 9C, 10 and 11, in contrast to the connector 60 shown in FIGS. 12A and 12B and described above, the preload application parts 25 are provided on each contact 21, so that it is not necessary to form on the housing 50 any preload application parts for applying a preload to the spring arms 24. Accordingly, the electrical connector 40 can be constructed with a low height by reducing the thickness of the housing 50, without considering the deformation of the housing during the reflow solder connection.

Furthermore, in the electrical contact 21, as is shown in FIG. 4F, when the component to be connected 10 contacts each contact protruding part 24*c* from above, the component to be connected 10 and the conductor pattern formed on the circuit board PCB are electrically connected. When the component to be connected 10 is lowered to a specified position, the contact protruding part 24*c* is displaced downward for a specified amount against the elastic force of the spring arm 24. In this state, the work of connecting the component to be connected 10 and the conductor pattern formed on the circuit board PCB is completed. In this case, the downward displacement of the contact protruding part 24*c* is guided by the pair of preload application parts 25. In this case, furthermore, the lateral wobbling of the contact 21 on the side of the fixed end of the spring arm 24 is restricted by the second engaging parts 27, the lateral wobbling of the contact 21 on the side opposite from the fixed end of the spring arm 24 is restricted by the first engaging parts 26, and the lateral wobbling of the spring arm 24 is also restricted.

If the displacement of the contact protruding part 24*c* is continued, the lower end 24*h* of the contact protruding part 24*c* on the side closer to the fixed end of the spring arm 24 first contacts the upper surface of the base plate 22, and the lower end 24*i* on the side distant from the fixed end of the spring arm 24 subsequently contacts the circuit board PCB.

Here, since the preload application parts 25 are provided toward the fixed end of the spring arm 24 relative to the contact protruding part 24*c*, there is no need to position the preload application parts 25 on the side farther than the contact protruding part 24*c* as seen from the fixed end of the spring arm 24. Accordingly, it is not necessary to form any extension part of the contact which is positioned beneath the preload application parts that are positioned on the side farther than the contact protruding part 24*c*. Consequently, in cases where the component to be connected 10 contacts the contact protruding part 24*c*, and continues to displace the contact protruding part 24*c* in this state, there is no possibility of such an extension part of the prior art contacting the upper surface of the circuit board before the lower end of the contact protruding part 24*c*, so that there is no danger that the amount of displacement of the contact protruding part 24*c* will be limited by such an extension part. Accordingly, it is possible to obtain a contact 21 with a large amount of displacement of the contact protruding part 24*c*, while having a low height.

Furthermore, the engaging parts 26 and 27 that engage with the housing 50 are provided both on the side of the fixed end of the spring arm 24 and on the side opposite from the fixed end of the spring arm 24 with respect to the preload application parts 25. Accordingly, when the component to be connected 10 contacts the contact protruding part 24*c* and presses this contact protruding part 24*c*, the contact 21 can be prevented from falling off by means of both engaging parts 26 and 27.

Moreover, since the first engaging parts 26 that are provided on the side opposite from the fixed end of the spring arm 24 with respect to the preload application parts 25 are press-fitted to the housing 50, the contact 21 can be securely fastened to the housing 50 by the first engaging parts 26. Furthermore, the second engaging parts 27 that are provided on the side of the fixed end of the spring arm 24 with respect to the preload application parts 25 engage with the slits 53 formed in the housing 50. Accordingly, when the component to be connected 10 contacts the contact protruding part 24*c* provided on the side opposite from the fixed end of the spring arm 24 with respect to the preload application parts 25, and presses this contact protruding part 24*c*, the contact 21 can be prevented from floating by the second engaging parts 27 provided on the side of the fixed end of the spring arm 24 with respect to the preload application parts 25. Therefore, the contact 21 can be prevented from falling off. Moreover, this in turn makes it possible to reduce the force applied to the soldering part 23, so that cracking of the solder can be avoided.

Figure 6A:
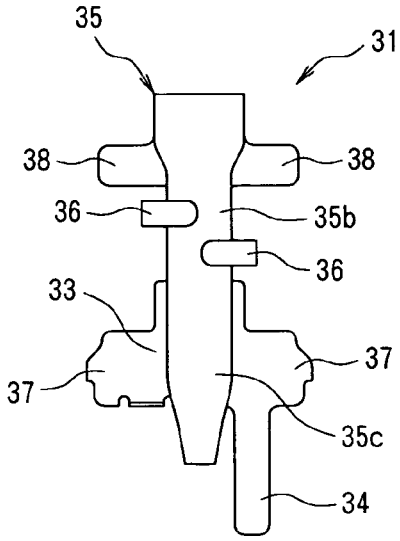
FIGS. 6A to 6F show the contact shown in FIGS. 5A and 5B, with FIG. 6A being a plan view, FIG. 6B being a back view, FIG. 6C being a bottom view, FIG. 6D being a front view, FIG. 6E being a left-side view, and FIG. 6F being a right-side view (in FIG. 6F, a circuit board and a component to be connected are both shown together as a one-dot chain line)
Figure 6C:
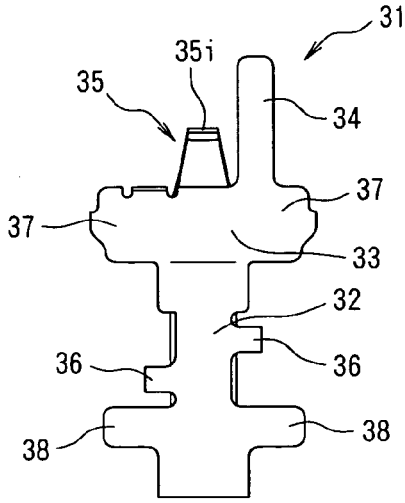
Figure 6B:
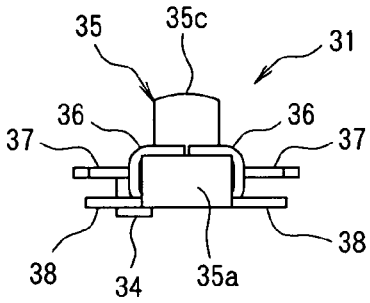
Figure 6D:
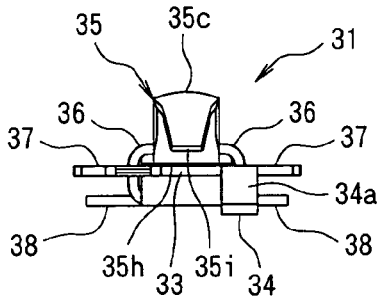
Figure 6E:
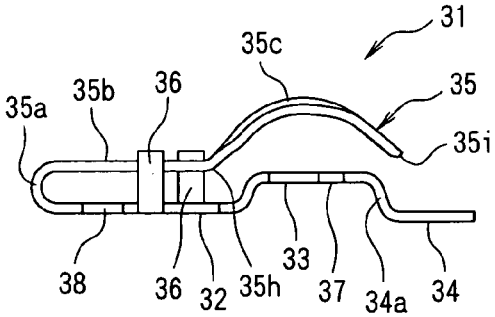
Figure 6F:
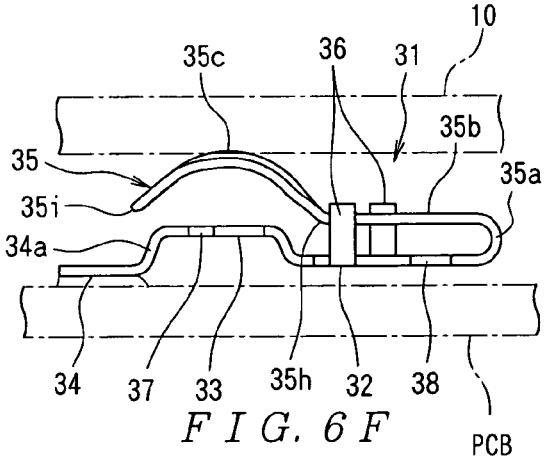
Figure 7A:
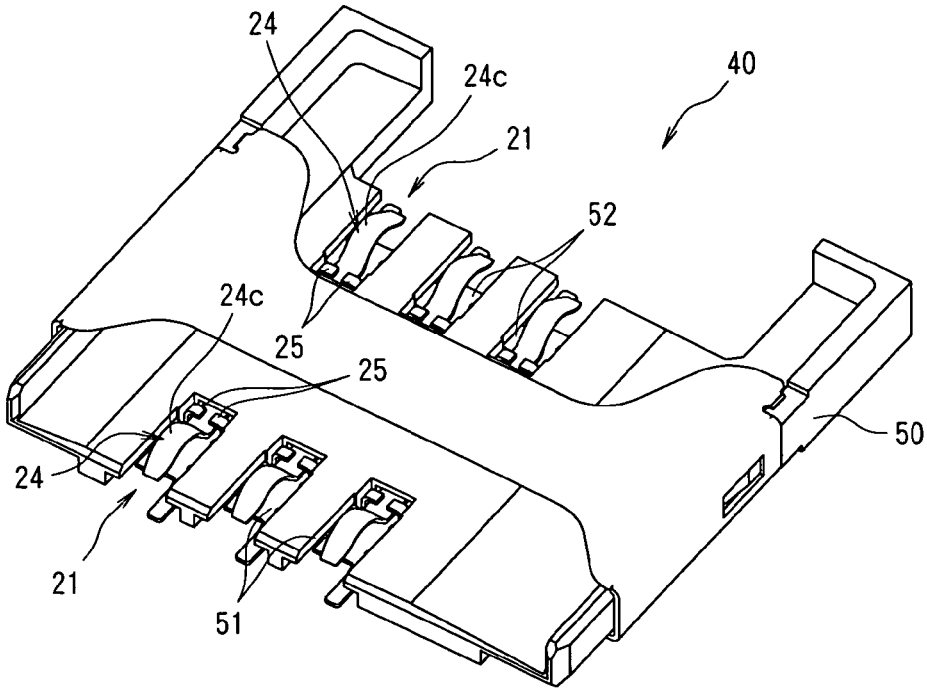
FIGS. 7A and 7B show an electrical connector according to an exemplary embodiment of the present invention, with FIG. 7A being a perspective view as seen from the front at an inclination from above, and FIG. 7B being a perspective view as seen from the back at an inclination from below.
Figure 7B:
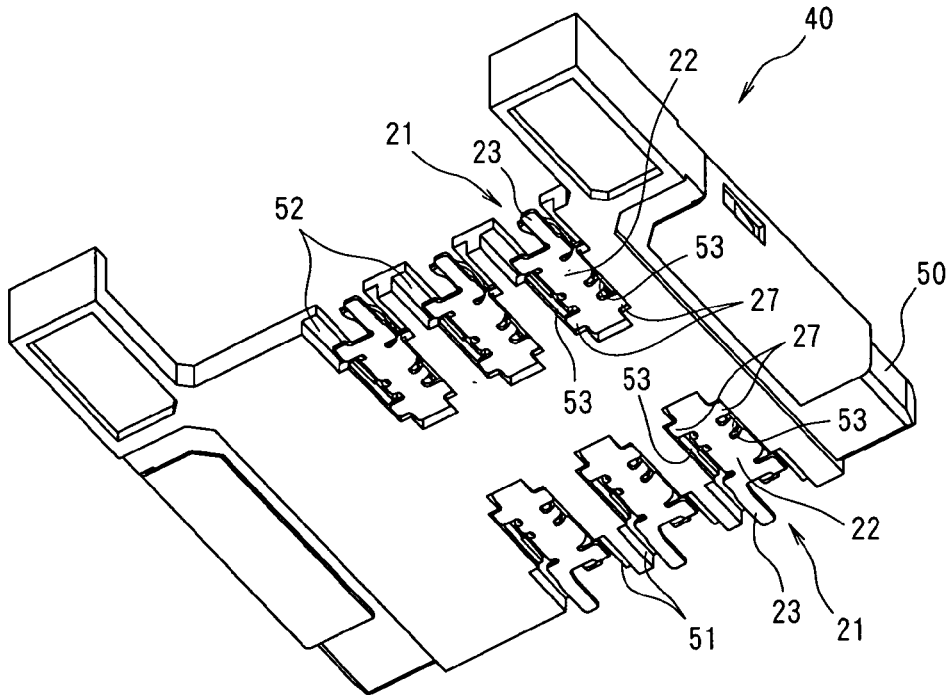
Figure 8A:
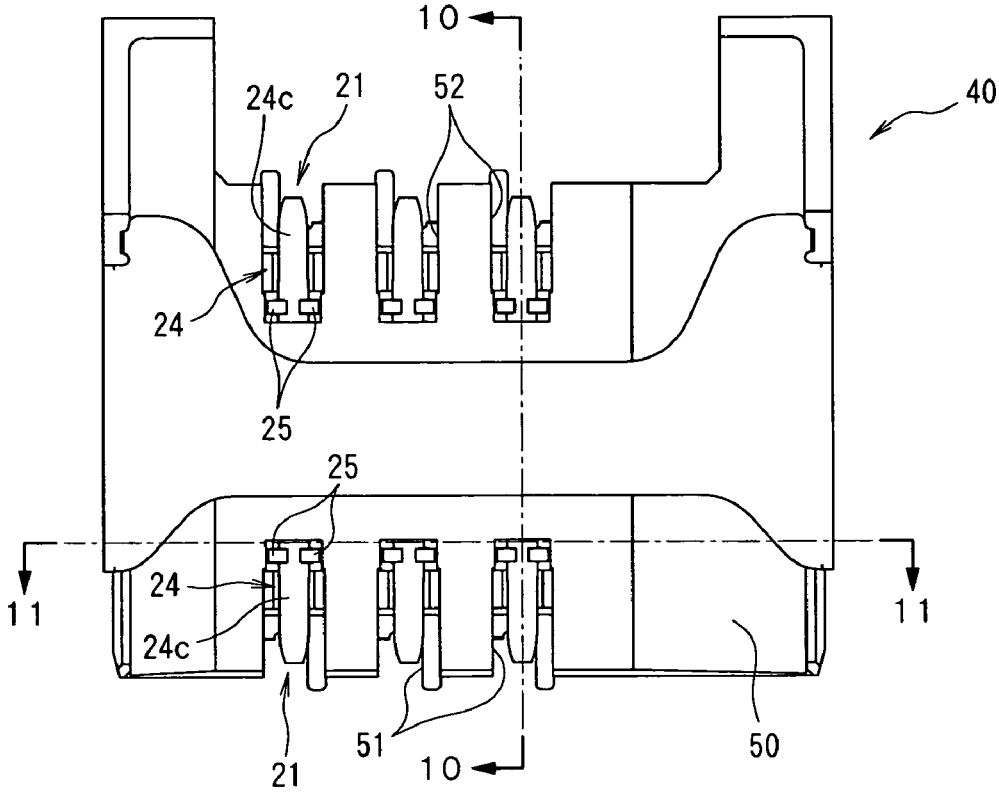
FIGS. 8A to 8C show the electrical connector shown in FIGS. 7A and 7B, with FIG. 8A being a plan view, FIG. 8B being a front view, and FIG. 8C being a back view.
Figure 8B:
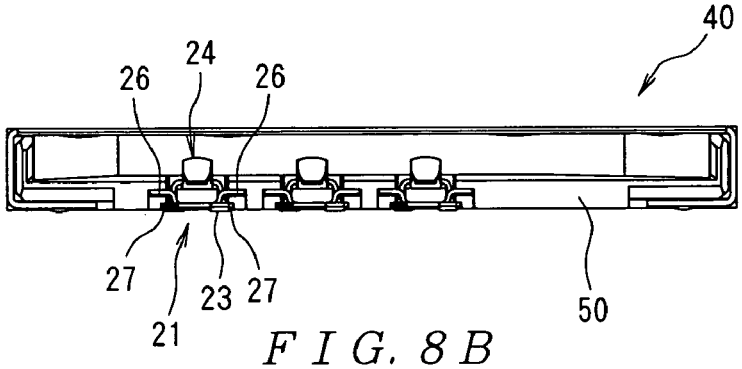
Figure 8C:
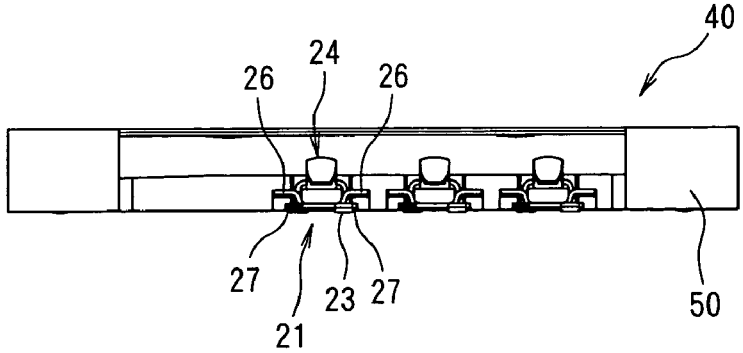
Figure 9A:
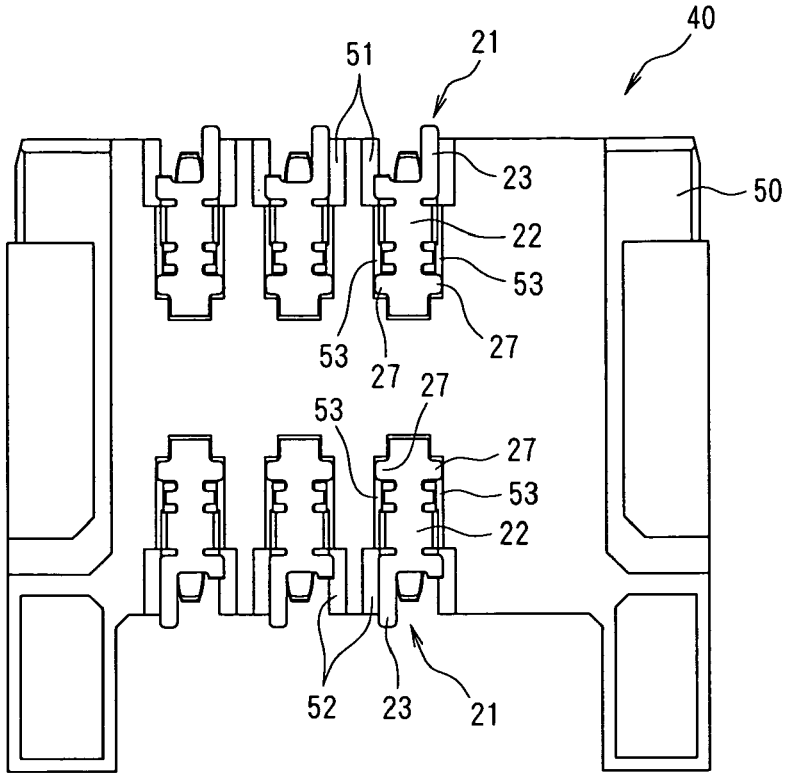
FIGS. 9A to 9C show the electrical connector shown in FIGS. 7A and 7B, with FIG. 9A being a bottom view, FIG. 9B being a right-side view, and FIG. 9C being a left-side view.
Figure 9B:
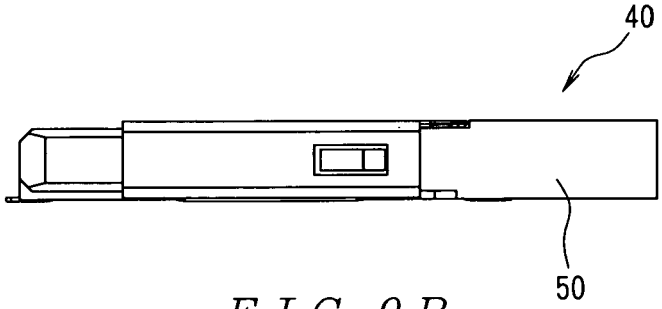
Figure 9C:
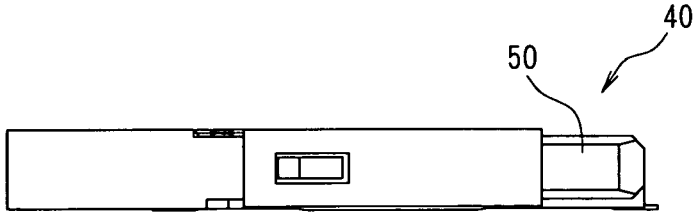
Figure 10:
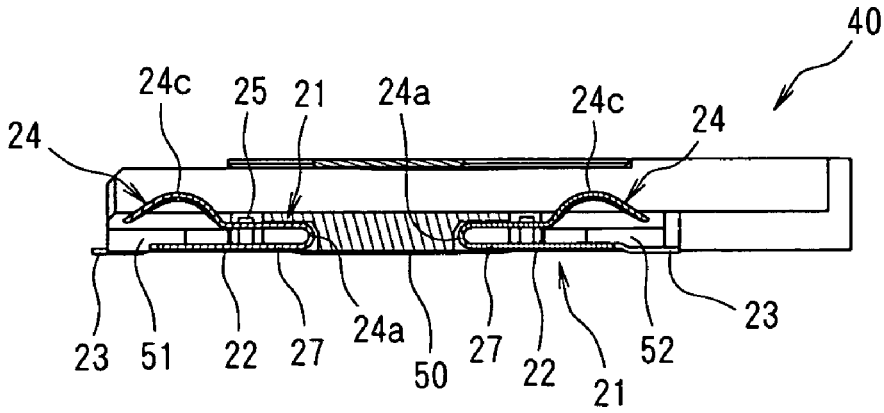
FIG. 10 is a sectional view along line 10—10 in FIG. 8A.
Figure 11:
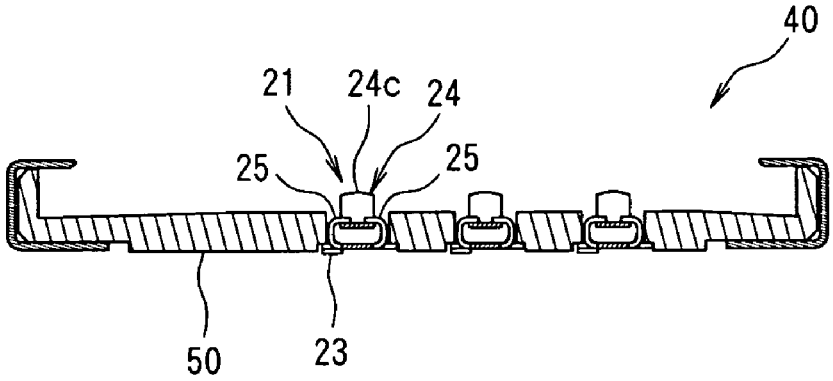
FIG. 11 is a sectional view along line 11—11 in FIG. 8A.

Next, a third embodiment of the contact of the present invention will be described with reference to FIGS. 5A and 5B, and 6A to 6F. In FIGS. 5A and 5B, and 6A to 6F, a contact 31 comprises a flat first base plate 32 that extends in the forward-rearward direction (left-right direction in FIG. 6F), and a flat second base plate 33 that is bent upward from the front end of the first base plate 32 and extends forward substantially parallel to the first base plate 32. The contact 31 is formed by stamping and forming a conductive metal plate having elasticity. A soldering part 34 extends forward from the front end of the second base plate 33 toward one side (toward the right side in FIG. 6A) via a step part 34*a* that extends downward at an inclination. The soldering part 34 is connected by reflow soldering to a conductor pattern formed on a circuit board PCB. Meanwhile, a spring arm 35 extends from the rear end of the first base plate 32. In effect, the spring arm 35 extends from the soldering part 34 via the second base plate 33 and first base plate 32. The spring arm 35 comprises a rectilinear part 35*b* that is bent back toward the front from the rear end of the first base plate 32 via a bent part 35*a*, and a contact protruding part 35*c* that is curved into an upward convex shape by protruding upward from the front end of the rectilinear part 35*b*. The rectilinear part 35*b* is formed with a slightly smaller width than that of the bent part 35*a*, and the contact protruding part 35*c* is formed with substantially the same width as that of the rectilinear part 35*b*. As is shown in FIG. 6F, the contact protruding part 35*c* is designed to be contacted by a component to be connected 10 that is positioned to face the circuit board PCB. As is shown most clearly in FIGS. 6D and 6F, the lower end 35*i* of the contact protruding part 35*c* on the side distant from the fixed end (bent part 35*a*) of the spring arm 35 is positioned slightly above the lower end 35*h* of the contact protruding part 35*c* on the side closer to the fixed end of the spring arm 35. Therefore, when the contact protruding part 35*c* is displaced downward, the lower end 35*h* on the side closer to the fixed end of the spring arm 35 first contacts the upper surface of the first base plate 32. The lower end 35*i* on the side distant from the fixed end of the spring arm 35 can be displaced until this end contacts the upper surface of the circuit board PCB. Both corners of the lower end 35*i* on the side distant from the fixed end of the spring arm 35 are beveled, thus preventing interference with the soldering part 34 when this lower end is lowered.

Furthermore, a pair of preload application parts 36 are raised from either side of the first base plate 32 in the direction of width substantially in the central portion in the forward-rearward direction. These preload application parts 36 are formed toward the fixed end of the spring arm 35 relative to the contact protruding part 35*c*, and are bent over the rectilinear part 35*b* of the spring arm 35, so that a preload is applied to the spring arm 35. The pair of preload application parts 36 are provided with the positions offset in the forward-rearward direction so that these preload application parts do not face each other on both sides of the contact 31 in the direction of width. The inner surfaces of the rising parts of the respective preload application parts 36 function as guide parts that guide the displacement of the contact protruding part 35*c* when the spring arm 35 is displaced. By providing the pair of preload application parts 36 so that these preload application parts do not face each other on both sides of the contact 31 in the direction of width, not only can the displacement of the contact protruding part 35*c* be securely guided, but the manufacture of the contact 31 can be facilitated compared to the case of the contact 21. When the contact 31 is formed using a mold during manufacture, since the pair of preload application parts 36 are provided with the positions offset in the forward-rearward direction, bending of the preload application parts 36 is easy. By the preload being applied to the spring arm 35, a load is applied to the spring arm 35 even before the component to be connected 10 contacts the contact protruding part 35*c*, so that it is possible to reduce the fluctuation of the load per the amount of displacement of the spring arm 35.

Moreover, a pair of first engaging parts 37, provided on the side opposite from the fixed end of the spring arm with respect to the preload application parts, extend substantially parallel to the second base plate 33 from either edge portion of the second base plate 33 in the direction of width on the side opposite from the fixed end of the spring arm 35 with respect to the preload application parts 36. These first engaging parts 37 designed to be are press-fitted to a housing (not shown in the figures). Furthermore, a pair of second engaging parts 38, provided on the side of the fixed end of the spring arm with respect to the preload application parts, extend substantially parallel to the first base plate 32 from either edge portion of the first base plate 32 in the direction of width on the side of the fixed end of the spring arm 35 with respect to the preload application parts 36. These second engaging parts 38 are designed to engage with slits (not shown in the figures) formed in the housing. The slits with which the second engaging parts 38 engage are formed by grooves that open on the side of the undersurface of the housing. Since the first engaging parts 37 are press-fitted to the housing, the press-fitting holes for the first engaging parts 37 formed in the housing are required to have thicker sections in the vertical direction. Accordingly, as is shown in FIGS. 6E and 6F, the first engaging parts 37 are provided at a high location relative to the second engaging parts 38, and the second engaging parts 38 are provided at a low location relative to the first engaging parts 37.

As in the contacts 21, the contacts 31 constructed in this manner are accommodated in the housing to constitute an electrical connector.

Furthermore, as is shown in FIG. 6F, the soldering parts 34 of the contacts 31 accommodated in the housing are connected by reflow soldering to the conductor pattern (not shown in the figures) formed on the circuit board PCB, so that the electrical connector is surface-mounted on the circuit board PCB.

During the connection of these soldering parts 34 by reflow soldering, the contacts 31 are pulled by the solder, so that the contacts 31 tend to float. However, the first engaging parts 37 and second engaging parts 38 that engage with the housing are provided on the contacts 31 both on the side of the soldering parts 34 and on the side opposite from the soldering parts 34 with respect to the preload application parts 36; accordingly, it is possible to prevent the contacts 31 from floating by mean of both engaging parts 37 and 38 even if the contacts 31 are pulled by the solder.

Furthermore, as is shown in FIG. 6F, when the component to be connected 10 contacts the contact protruding part 35*c* from above, the component to be connected 10 and the conductor pattern formed on the circuit board PCB are electrically connected. When the component to be connected 10 is lowered to a specified position, the contact protruding part 35*c* is displaced downward for a specified amount against the elastic force of the spring arm 35. In this state, the work of connecting the component to be connected 10 and the conductor pattern formed on the circuit board PCB is completed. In this case, the downward displacement of the contact protruding part 35*c* is guided by the pair of preload application parts 36. In this case, furthermore, the lateral wobbling (wobbling in the left-right direction in FIG. 6A) of the contact 31 on the side of the fixed end of the spring arm 35 is restricted by the second engaging parts 38, the lateral wobbling of the contact 31 on the side opposite from the fixed end of the spring arm 35 is restricted by the first engaging parts 37, and the lateral wobbling of the spring arm 35 is also restricted.

If the displacement of the contact protruding part 35*c* is continued, the lower end 35*h* of the contact protruding part 35*c* on the side closer to the fixed end of the spring arm 35 first contacts the upper surface of the first base plate 32. The lower end 35*i* on the side distant from the fixed end of the spring arm 35 can be displaced until this lower end 35*i* contacts the circuit board PCB.

Here, since the preload application parts 36 are provided toward the fixed end of the spring arm 35 relative to the contact protruding part 35*c*, there is no need to position the preload application parts 36 on the side farther from the fixed end of the spring arm 35 than the contact protruding part 35*c*. Accordingly, it is not necessary to form any extension part of the contact which is positioned beneath the preload application parts that are positioned on the side farther from the fixed end than the contact protruding part 35*c*. Consequently, in cases where the component to be connected 10 contacts the contact protruding part 35*c*, and continues to displace the contact protruding part 35*c* in this state, there is no possibility of such an extension part of the prior art contacting the upper surface of the soldering part before the lower end of the contact protruding part 35*c*, so that there is no danger that the amount of displacement of the contact protruding part 35*c* will be limited by such an extension part. Accordingly, it is possible to obtain a contact 31 with a large amount of displacement of the contact protruding part 35*c*, while having a low height.

Furthermore, the first and second engaging parts 37 and 38 that engage with the housing are provided both on the side of the fixed end of the spring arm 35 and on the side opposite from the fixed end of the spring arm 35 with respect to the preload application parts 36. Accordingly, when the component to be connected 10 contacts the contact protruding part 35*c* and presses this contact protruding part 35*c*, the contact 31 can be prevented from falling off by means of both engaging parts 37 and 38.

Moreover, since the first engaging parts 37 that are provided on the side opposite from the fixed end of the spring arm 35 with respect to the preload application parts 36 are press-fitted to the housing, the contact 31 can be securely fastened to the housing by the first engaging parts 37. Furthermore, the second engaging parts 38 that are provided on the side of the fixed end of the spring arm 35 with respect to the preload application parts 36 engage with the slits formed in the housing. Accordingly, when the component to be connected 10 contacts the contact protruding part 35*c* provided on the side opposite from the fixed end of the spring arm 35 with respect to the preload application parts 36, and presses this contact protruding part 35*c*, the contact 31 can be prevented from floating by the second engaging parts 38 provided on the side of the fixed end of the spring arm 35 with respect to the preload application parts 36. Therefore, the contact 31 can be prevented from falling off. Moreover, this in turn makes it possible to reduce the force applied to the soldering part 34, so that cracking of the solder can be avoided.

The embodiments of the present invention were described above. However, the present invention is not limited to these embodiments, and various alterations and modifications can be made.

For example, the component to be connected is not limited to the casing 10; it would also be possible to cause the contact protruding part 3*g*, 24*c*, 35*c* to contact a conductor pattern formed on another circuit board other than the circuit board PCB.

Moreover, the lower end 3*i* of the contact protruding part 3*g* on the side distant from the fixed end of the spring arm 3 may also be positioned at the same height as or beneath the lower end 3*h* on the side closer to the fixed end of the spring arm 3 as long as this lower end 3*i* is positioned not to contact the upper surface of the soldering part 2 when the work of connecting the casing 10 and the conductor pattern formed on the circuit board PCB is completed.

Furthermore, the pair of preload application parts 25 are provided on either side of the contact 21 in FIGS. 3A and 3B, and 4A to 4F, and the pair of preload application parts 36 are provided on either side of the contact 31 in FIGS. 5A and 5B, and 6A to 6F. However, it would also be possible to form a single preload application part on one side of a contact, which makes it possible to construct a contact in a compact manner.

In addition, an electrical connector to which the present invention is applied is not limited to a SIM card connector.

What is claimed is:

1. A contact comprising:

a base plate;

a soldering part that extends from a front end of the base plate, the soldering part being soldered to a conductor pattern formed on a circuit board;

a spring arm that extends from a rear end of the base plate, the spring arm having a contact protruding part for contacting a component to be connected that is positioned to face the circuit board; and a preload application part that extends from the base plate and contacts the spring arm so that a preload is applied to the spring arm, the preload application part being provided toward a fixed end of the spring arm relative to the contact protruding part;

a pair of first engaging parts configured for engaging a housing extend from sides of the base plate on a side opposite from the fixed end of the spring arm with respect to the preload application part; and a pair of second engaging parts configured for engaging the housing extend from sides of the base plate on a side of the fixed end of the spring arm with respect to the preload application part, the pair of first engaging parts being positioned at a different height than the pair of second engaging parts relative to the base plate.

2. The contact of claim 1, wherein the pair of first engaging parts have raised cut parts.

3. The contact of claim 1, wherein the pair of first engaging parts are raised from the base plate by a bent part.

4. The contact of claim 1, wherein the pair of first engaging parts are configured for press-fitting to the housing.

5. The contact of claim 1, wherein the preload application part extends from both sides of the base plate, the preload application part extending from the sides of the base plate being offset from each other.

6. An electrical connector comprising:

contacts having a base plate with a soldering part extending there from that is soldered to a conductor pattern formed on a circuit board, a spring arm that extends from the base plate that has a contact protruding part for contacting a component to be connected that is positioned to face the circuit board, a preload application part that extends from the base plate and contacts the spring arm so that a preload is applied to the spring arm, the preload application part being provided toward a fixed end of the spring arm relative to the contact protruding part, a pair of first engaging parts formed on a side opposite from the fixed end of the spring arm with respect to the preload application part, and a pair of second engaging parts formed on a side of the fixed end of the spring arm with respect to the preload application part; and a housing that accommodates these contacts, the housing having a pair of press-fitting holes that receive the pair of first engaging parts and a pair of slits that receive the second engaging parts;

wherein the electrical connector is surface-mounted on the circuit board.

7. The contact of claim 6, wherein the pair of first engaging parts are positioned at a different height than the pair of second engaging parts relative to the base plate.

8. The contact of claim 6, wherein the pair of first engaging parts and the pair of second engaging parts extend from sides of the base plate, the pair of first engaging parts being raised from the base plate by a bent part.

9. The contact of claim 6, wherein the pair of first engaging parts have raised cut parts.

10. The contact of claim 6, wherein the preload application part extends from both sides of the base plate, the preload application part extending from the sides of the base plate being offset from each other.

* * * * *

UNITED STATES PATENT AND TRADEMARK OFFICE

CERTIFICATE OF CORRECTION

PATENT NO. : 7,131,875 B2
APPLICATION NO. : 11/085393
DATED : November 7, 2006
INVENTOR(S) : Kazuaki Kodaira et al.

It is certified that error appears in the above-identified patent and that said Letters Patent is hereby corrected as shown below:

In column 15, line 1, "housing that accommodates these" should read -- housing that accommodates the --.

Signed and Sealed this

Twenty-fourth Day of April, 2007

JON W. DUDAS
*Director of the United States Patent and Trademark Office*